United States Patent [19]

Campbell et al.

[11] 4,348,157

[45] Sep. 7, 1982

[54] AIR COOLED TURBINE FOR A GAS TURBINE ENGINE

[75] Inventors: David A. Campbell, Borrowash; Frederick W. W. Morley, Castle Donington, both of England

[73] Assignee: Rolls-Royce Limited, London, England

[21] Appl. No.: 85,300

[22] Filed: Oct. 16, 1979

[30] Foreign Application Priority Data

Oct. 26, 1978 [GB] United Kingdom ..... 42094/78

[51] Int. Cl.[3] ..... F01D 5/18

[52] U.S. Cl. ..... 41.6/95; 415/115

[58] Field of Search ..... 415/115–117; 416/95

[56] References Cited

U.S. PATENT DOCUMENTS

| | | | |
|---|---|---|---|
| 2,988,325 | 6/1961 | Dawson | 416/95 |
| 3,635,586 | 1/1972 | Kent | 415/115 X |
| 3,663,118 | 5/1972 | Johnson | 415/116 |
| 3,791,758 | 2/1974 | Jenkinson | 415/116 |
| 3,826,084 | 7/1974 | Branstrom et al. | 415/115 X |

FOREIGN PATENT DOCUMENTS

| | | | |
|---|---|---|---|
| 1300346 | 7/1969 | Fed. Rep. of Germany | 416/193 A |
| 2920193 | 11/1979 | Fed. Rep. of Germany | 416/95 |
| 947553 | 1/1964 | United Kingdom | 416/95 |

*Primary Examiner*—Everette A. Powell, Jr.

*Attorney, Agent, or Firm*—Cushman, Darby & Cushman

[57] ABSTRACT

An air cooled turbine which has cooling air provided through pre-swirl nozzles into an annulus formed between radially inner and outer seals and then into cooling air inlets to the turbine blading, has leakage air deflector means to prevent the leakage flow from the inner to outer seal interfering with the cooling air flow. The deflector means may comprise leakage flow inlets adjacent the inner seal, channels extending radially and cooperating with the turbine rotor to provide passages for the leakage flow to a location radially outboard of the cooling air inlets to the turbine blading, and open portions through which the cooling air can flow to the cooling air inlets. The channel outlets of the deflector may be arranged so that some of the leakage flow can be directed to cool a less critical part of the turbine blading the remaining leakage flow being directed radially outboard of the cooling air inlets to a more critical part of the turbine blading which are arranged to receive the normal cooling air flow.

5 Claims, 6 Drawing Figures

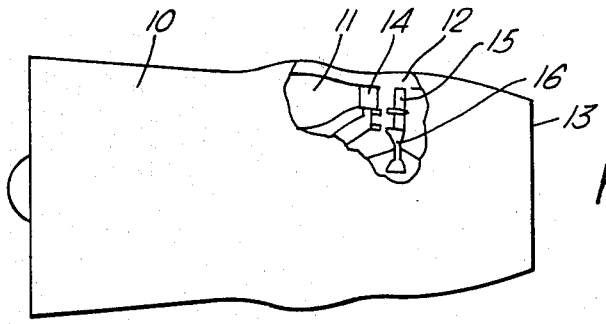
Fig. 1.
Fig. 2.
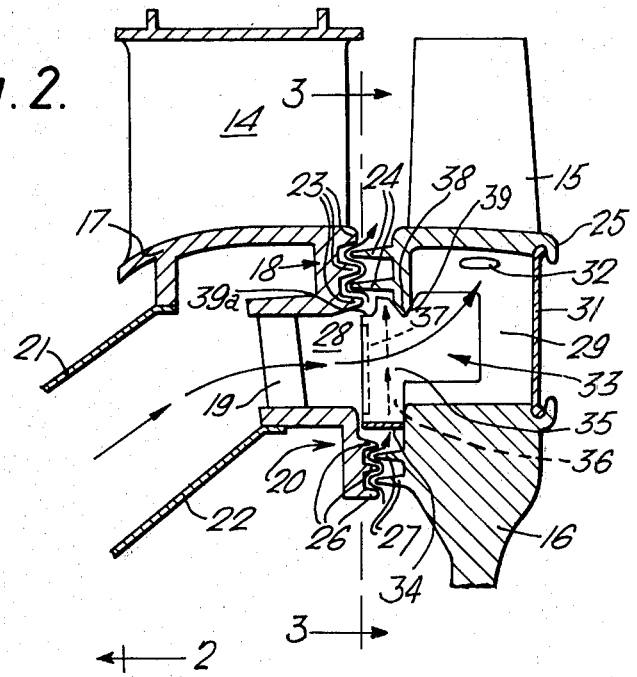
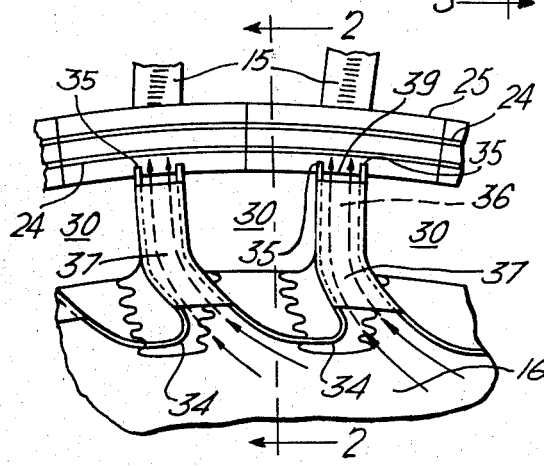
Fig. 3.

Fig. 4.
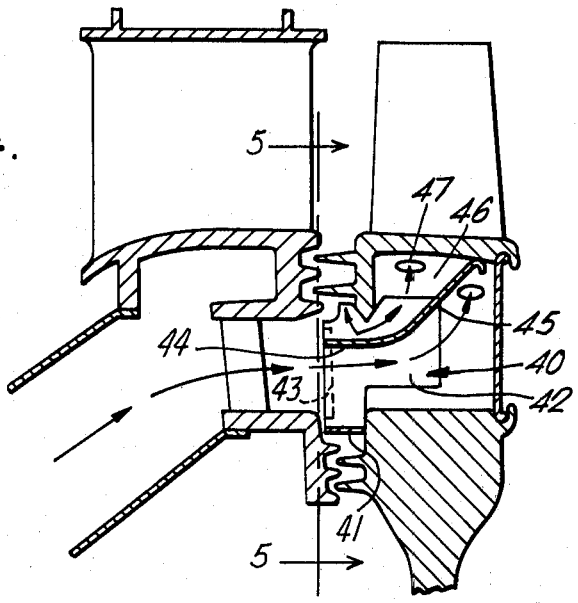
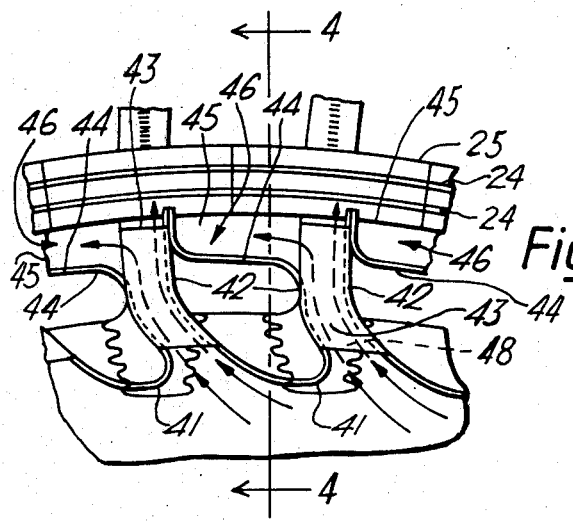
Fig. 5.
Fig. 6.
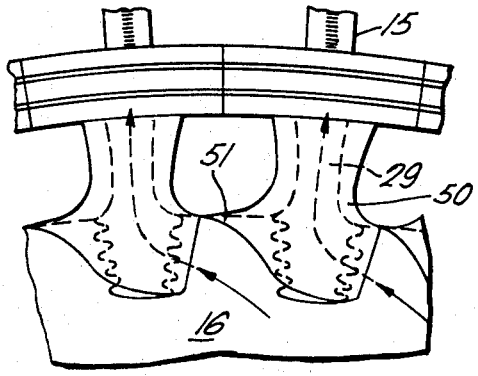

AIR COOLED TURBINE FOR A GAS TURBINE ENGINE

This invention relates to an air cooled turbine for a gas turbine engine.

One popular arrangement for cooling the rotor blades of such a turbine involves the use of cooling air which is blown through so-called preswirl nozzles in static structure of the engine and impinges on the turbine rotor. Apertures in the rotor then allow this air to flow into the blades themselves and to provide cooling. The transfer of the cooling air from static to rotating structure takes place in a sealed annular chamber formed between inner and outer annular seals. The pressures existing round this seal (normally the pressure of the main gas flow at this point) is lower than the pressure within the chamber which in turn is lower than the pressure inside the inner seal.

Thus because of the imperfection of the various seals used, there is a constant leakage flow of air from inside the inner seal into the chamber, and from the chamber into the main gas annulus. It has been found that the air leaking through the inner seal tends to replace some of the cooling air by flowing into the rotor blades, and because this air is hotter than the preswirled cooling air and has a lower tangential velocity this reduces the cooling and performance of the overall system.

The present invention provides apparatus in which at least a proportion of the leakage flow is caused not to flow into the rotor blades.

According to the present invention an air-cooled turbine for a gas turbine engine comprises a rotor including a disc carrying a stage of rotor blades, static structure adjacent the outer portion of the rotor, inner and outer annular seals between the static structure and the rotor, the seals defining between them a space adjacent the rotor, preswirl nozzles adapted to direct cooling air from the static structure and across the space toward the rotor, cooling air entry means adapted to allow said cooling air to enter the blades to cool them, and deflector means mounted on the rotor in between said seals and adapted to deflect air or gas leaking through said inner seal away from said cooling air entry means.

Preferably the deflector means includes radially extending passages extending from radially inboard of the cooling air entry means to radially outboard of the cooling air entry means so as to provide a flow path for the leakage air past the cooling air entry means.

These passages may be provided with flow-dividing inlets which prevent the leakage air from flowing into the cooling air entry means.

Thus the deflector means may comprise a sheet metal structure comprising flow dividing inlets at its radially inner extent for the leakage flow, channels which extend radially and cooperate with the rotor or blade face to provide passages for the leakage flow to a location radially outboard of the air entry means, and open portions which correspond with the air entry means so as to allow the unrestricted flow of cooling air into the air entry means.

The invention will now be particularly described merely by way of example, with reference to the accompanying drawings in which:

FIG. 1 is a partly broken-away view of a gas turbine engine having an air-cooled turbine in accordance with the present invention, FIG. 2 is a section through part of the air cooled turbine of FIG. 1, the view being taken substantially on the line 2—2 of FIG. 3, FIG. 3 is a view on the face of the blade-carrying disc of FIG. 2, the view being taken substantially on the line 3—3 of FIG. 2, FIG. 4 is a section similar to FIG. 2 but of a further embodiment taken substantially on the line 4—4 of FIG. 5, FIG. 5 is a view on the face of the blade-carrying disc of FIG. 4, the view being taken substantially on the line 5—5 of FIG. 4, and FIG. 6 is a view similar to FIGS. 3 and 5 but of a still further embodiment.

In FIG. 1 there is shown a gas turbine engine comprising a compressor 10, combustion section 11, turbine 12 and final nozzle 13. The casing of the engine is broken away in the region of the turbine 12 so as to expose to view the nozzle guide vanes 14, turbine rotor blades 15 and turbine disc 16.

Overall operation of the engine is conventional and not, therefore, elaborated here. However, because the turbine rotor blades 15 are subject to the impact of the hot gases issuing from the combustion section 11 through the nozzle guide vanes 14, the blades are provided with a cooling air system. To provide cooling air to the blades it is necessary to arrange for the passage of cooling air from static structure of the engine in the vicinity of the nozzle guide vanes 14 to the blades 15, and the apparatus for carrying this out is shown in detail in FIGS. 2 and 3.

Referring first to FIG. 2, it will be seen that the nozzle guide vanes 14 have inner platforms 17 from which are carried static structures which comprises an outer labyrinth seal member 18, a row of swirler nozzles 19 and an inner labyrinth seal member 20. A pair of sheet metal wall members 21 and 22 are sealed to the platforms 17 and the inner labyrinth seal member 20 respectively. Between them the wall members 21 and 22 define an annular passage for bleed air from the compressor 10. Although not shown, it will be understood that this bleed air may be taken for instance from the downstream end of the compressor or through the inner casing of the combustion chamber.

In order to provide an effective seal, the member 18 is provided with three annular sealing fins 23 between which are interdigitated the two annular sealing fins 24 which extend from the inner platform 25 of the blades 15.

In a similar manner the member 20 has three annular fins 26 between which are interdigitated the two annular fins 27 extending from the disc 16. Thus the labyrinth seals produced in this way define between them an annular space 28.

Facing the row of swirler nozzles 19 across the annular space 28 are the shanks 29 of the blades 15 and the apertures 30 formed between adjacent shanks. These apertures are open to the space 28 but are sealed off at their other ends by sealing and locking plates 31. An opening 32 in the wall of each blade shank 29 leads to the array of cooling air passages (not shown) within the blade 15 so as to allow the flow of cooling air into these passages.

As described so far the arrangement is conventional, and it will be appreciated that under the normal circumstances of pressure in the space 28 higher than that outside the seal made up of fins 23 and 24 but lower than that inside the seal made up of fins 26 and 27, there will be leakage of air through the inner seal into the space 28 and through the outer seal out of the space 28. Because of the high rotational speed of the disc 16 and blades 15 this leakage flow will tend to stick to the rotor surface and will therefore flow into the spaces 30 and the openings 32.

The air intended to flow into these spaces and openings is that fed through the swirlers 19 and across the space 28. The leakage air displaces a proportion of this air, and being at a higher temperature and having a lower tangential velocity than the preswirled cooling air will degrade the cooling performance of the system.

In order to prevent this happening or at least to reduce the degree to which it happens a deflector generally indicated at 33 is provided. As can be seen from FIGS. 2 and 3 the deflector 33 comprises a plurality of flow dividing air intakes 34 each of which has two walls perpendicular to the disc face which substantially form the walls 35 of leakage air passages 36. Each passage 36 is covered over by a joining portion 37 which lies parallel with the disc face and joins the adjacent walls 35. The area between the walls 35 adjacent each passage 36 is left open so that access of coling air travelling roughly at right angles relative to the disc face and into the apertures 30 will be subsequentially unaffected.

In order to ensure that the deflector 33 is held on the bladed disc, each of the walls 35 is arranged to extend into an aperture 30 lying against the surface of one of the shanks 29 forming the apertures, and each wall 35 has a notch 38 which engages with the downward projecting rim 39 from the platforms 25. It will also be noted that in the present embodiment the walls 35 and joining portion 37 are cut away at their outer extremity at 39*a* to provide clearance for the innermost fin 23 of the outer seal.

Operation of this system is that the seal leakage air passing between the fins 26 and 27 and flowing adjacent the surface of the disc 16 is divided by the intakes 34 and directed to flow through the passages 36 to exhaust just inside the outer seals fins 23 and 24. This air thus 'by-passes' the apertures 30, and subject to recirculation effects and leakages will not enter these apertures.

On the other hand, the cooling air directed by the swirlers 19 across the space 28 will be largely prevented from flowing into the passages 36 by the joining portion 37; its access to the apertures 30 however is substantially unaffected. This cooling air therefore enters the apertures 30 and provides cooling for the blades via the openings 32, while the seal leakage air from the inner seal by-passes the apertures 30 and will at least in part form the seal leakage through the outer seal.

It will be seen that this embodiment causes substantially all the seal leakage air to by-pass the apertures 30. In some applications this air may be of some use in cooling less critical parts of the blade aerofoil, and the embodiment shown in FIGS. 4 and 5 enables a proportion of the leakage air to be fed, separately from the main cooling air supply, to the blade.

The basic structure of FIGS. 4 and 5 is exactly the same as that of FIGS. 2 and 3 and is not described. However, in this case the deflector generally indicated at 40, besides having the inlets 41 walls 42 and joining portion 43 which correspond with those of the deflectors 33, has an extension 44 to alternate walls 42 which extends across the apertures 30 to join the opposite wall 42. This extension also extends into the aperture 30 to join the opposite wall 42. This extension also extends into the aperture 30 and has an upstanding portion 45 which seals against the underside of the platform 25. In this way a subdivided space 46 which is part of the aperture 30 is formed, sealed off from the rest of the aperture and comunicates via an opening 47 with a non-critical part of the internal blade cooling layout (not shown).

The walls 42 carrying the extensions 44 and 45 are each cut away so that air may flow from the seal leakage air passages 48 into the subdivided space 46 and thus into the openings 47.

Operation of this embodiment is basically similar to that of FIGS. 2 and 3, but in this case only part of the seal leakage air flows to the underside of the inner fins of the outer seal, the remainder flowing out of the passages 48 into the spaces 46 and thus to provide cooling of the blades in non-critical areas.

It will be seen that both embodiments of the invention described above allow the seal leakage air to be segregated from the blade cooling air, although the weight of the deflectors involved represents a penalty. The sheet metal constructions illustrated are of relatively lighweight but could of course be replaced by integral or attached cast deflector structures, which would have shapes different from those illustrated.

Thus FIG. 6 illustrates a different form of deflector which in this case takes the form of a separate cast member 50 which is brazed or otherwise metallurgically joined to the faces of the shanks 29 of the rotor blades 15 or to the face of the disc 16. It will be seen that each deflector comprises a hollow body within which a passage is formed to deflect the leakage air from its initial path relative to the disc into a radial direction relative to the disc, and an extension 51 which forms the wall to prevent this leakage air from entering the between-blade spaces 30. The deflectors 50 otherwise operate in exactly similar manner to those of the previous embodiments.

We claim:

1. An air cooled turbine for a gas turbine engine comprises a rotor including a disc carrying a stage of rotor blades, static structure adjacent the outer portion of the rotor, inner and outer annular seals between the static structure and the rotor, the seals defining between them a space adjacent the rotor, pre-swirl nozzles upstream of said space for directing cooling air from the static structure and across the space toward the rotor, cooling air entry means adapted to allow said cooling air to enter the blades to cool them, and deflector means mounted on the rotor in between said seals, said deflector means deflecting fluid of higher pressure than said cooling air which leaks radially outwardly through said inner seal away from said cooling air entry means.

2. An air cooled turbine as claimed in claim 1 in which the deflector means includes radially extending passages extending from radially inboard of the cooling air entry means to radially outboard of the cooling air entry means so as to provide a flow path for the leakage flow between the inner and outer seals past the cooling air entry means.

3. An air cooled turbine as claimed in claim 1 in which the deflector means include leakage flow dividing inlets to prevent the leakage flow from flowing into the cooling air entry means.

4. An air cooled turbine as claimed in claim 1 in which the deflector means comprises leakage flow dividing inlets at its radially inner extent, channels extending radially and cooperating with the rotor to provide passages for the leakage flow to a location radially outboard of the cooling air entry means, and open portions in communication with the cooling air entry means so as to allow unrestricted flow of cooling air from the preswirl nozzles and across the said space into the cooling air entry means.

5. An air cooled turbine as claimed in claim 1 in which the cooling air entry means comprises first and second cooling air entry apertures, the deflector means comprising leakage flow dividing inlets at its radially inner extent, channels extending radially and cooperating with the rotor, each said channel having a first outlet providing a passage for the leakage flow to a location radially outboard of the first cooling air entry apertures and a second outlet providing a passage for the leakage flow to the second cooling air entry apertures, and open portions in communication with the first cooling air entry apertures so as to allow unrestricted flow of cooling air from the preswirl nozzles and across said space into the first cooling air entry apertures.

* * * * *